US007872462B2

(12) United States Patent
Erbito, Jr.

(10) Patent No.: US 7,872,462 B2
(45) Date of Patent: Jan. 18, 2011

(54) BANDGAP REFERENCE CIRCUITS

(75) Inventor: Rogelio L. Erbito, Jr., Singapore (SG)

(73) Assignee: Vanguard International Semiconductor Corporation, Hsinchu (TW)

( * ) Notice: Subject to any disclaimer, the term of this patent is extended or adjusted under 35 U.S.C. 154(b) by 338 days.

(21) Appl. No.: 12/259,239

(22) Filed: Oct. 27, 2008

(65) Prior Publication Data

US 2010/0102794 A1 Apr. 29, 2010

(51) Int. Cl.
*G05F 3/16* (2006.01)

(52) U.S. Cl. ..... 323/314; 327/539

(58) Field of Classification Search ..... 323/312–316; 327/538–543

See application file for complete search history.

(56) References Cited

U.S. PATENT DOCUMENTS 6,046,577 A * 4/2000 Rincon-Mora et al. ..... 323/282
7,737,674 B2 * 6/2010 Erbito, Jr. ..... 323/313
7,821,328 B2 * 10/2010 Hoque et al. ..... 327/536
2010/0195358 A1 * 8/2010 Erbito, Jr. ..... 363/84

* cited by examiner

*Primary Examiner*—Jessica Han

(57) ABSTRACT

A bandgap reference circuit is provided. An input node receives a supply voltage. An output node provides a reference voltage. A first transistor is coupled between the input node and the output node and has a first control terminal. A resistor is coupled between the input node and the first control terminal. A second transistor is coupled to the first control terminal and has a second control terminal coupled to the output node. A third transistor is coupled between the second transistor and a ground terminal and has a third control terminal. A voltage dividing unit provides a first voltage and a second voltage according to the reference voltage. A differential amplifier provides a signal to the third control terminal according to a difference between the first and second voltages.

20 Claims, 3 Drawing Sheets

BANDGAP REFERENCE CIRCUITS

BACKGROUND OF THE INVENTION

1. Field of the Invention

The invention relates to a bandgap reference circuit, and more particularly to a high voltage and low quiescent current bandgap reference circuit.

2. Description of the Related Art

Electronic circuits, such as analog to digital converters, linear or switching voltage regulators and so on, often require a reference voltage which is stable and constant despite temperature and power supply variations. A bandgap reference circuit is typically used to provide such a temperature-independent and power-supply-independent reference voltage which is referred to as a bandgap voltage.

FIG. 1 shows a conventional bandgap reference circuit 100. The bandgap reference circuit 100 utilizes a feedback loop to establish an operating point such that an output voltage VREF is generated by a first voltage and a second voltage. The first voltage is related to a multiple of the base to emitter voltage differential ($\Delta V_{BE}$) of a pair of transistors Q1 and Q2 operating at different current densities, and the second voltage is related to the base to emitter voltage $V_{BE}$ of a transistor Q3. In FIG. 1, the transistors Q1, Q2 and Q3 are NPN type bipolar junction transistors. Furthermore, the first voltage $\Delta V_{BE}$ is proportional to the absolute temperature (PTAT) and thus has a positive temperature coefficient, and the second voltage $V_{BE}$ has a negative temperature coefficient. Thus, the sum of $K\Delta V_{BE}$ (where K is a multiple) and the base to emitter voltage $V_{BE}$ produces a voltage that has nearly no temperature dependence and no power-supply dependence.

In general, an analog circuit needs a stable bandgap voltage for proper performance. However, most high voltage analog circuits do not have a temperature-independent and power-supply-independent bandgap voltage. Therefore, providing a high voltage and low quiescent current bandgap reference circuit for a high voltage analog circuit is desired.

BRIEF SUMMARY OF THE INVENTION

Bandgap reference circuits are provided. An exemplary embodiment of a bandgap reference circuit is provided. An input node receives a supply voltage and an output node provides a reference voltage. A first transistor is coupled between the input node and the output node and has a first control terminal. A first resistor is coupled between the input node and the first control terminal. A second transistor is coupled to the first control terminal and has a second control terminal coupled to the output node. A third transistor is coupled between the second transistor and a ground terminal and has a third control terminal. A voltage dividing unit provides a first voltage and a second voltage according to the reference voltage. A differential amplifier provides a signal to the third control terminal according to a difference between the first voltage and the second voltage.

Furthermore, another exemplary embodiment of a bandgap reference circuit is provided.

A detailed description is given in the following embodiments with reference to the accompanying drawings. An input node receives a supply voltage and an output node provides a reference voltage. A first transistor is coupled between the input node and the output node and has a gate. A first resistor is coupled between the input node and the gate of the first transistor. A first NPN type bipolar junction transistor is coupled to the first control terminal and has a base coupled to the output node. A second transistor is coupled between the first NPN type bipolar junction transistor and a ground terminal and has a gate. A voltage dividing unit provides a first voltage and a second voltage according to the reference voltage. A differential amplifier provides a signal to the gate of the second transistor according to a difference between the first voltage and the second voltage. The first transistor and the second transistor are NMOS transistors, and the first transistor has a breakdown voltage higher than the third transistor.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

A bipolar-CMOS-DMOS (BCD) process is a widely used semiconductor process for power application devices. By using the BCD process, low voltage MOS transistors, high voltage MOS transistors (DMOS) and bipolar junction transistors (BJT) (both NPN and PNP BJTs are available) can be simultaneously provided in a circuit/device. One of the advantages of the BCD process is the availability of a high voltage device. Moreover, due to the NPN BJTs provided by the BCD process, a good device matching characteristic is achieved, which may decrease an offset at the input of a differential amplifier.

Figure 1:
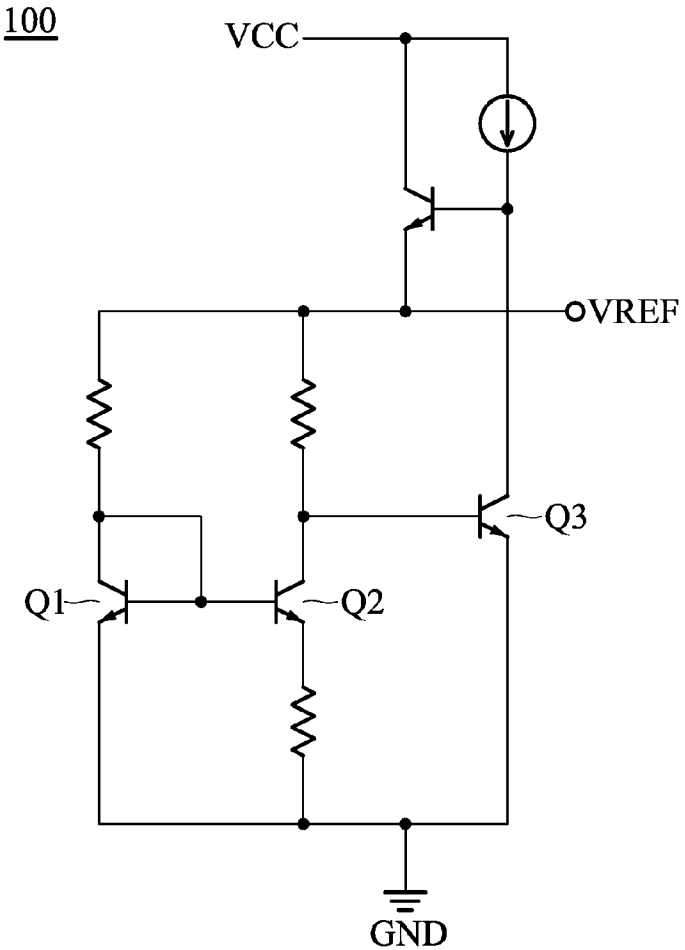
FIG. 1 (PRIOR ART)
FIG. 1 shows a conventional bandgap reference circuit 100.
Figure 2:
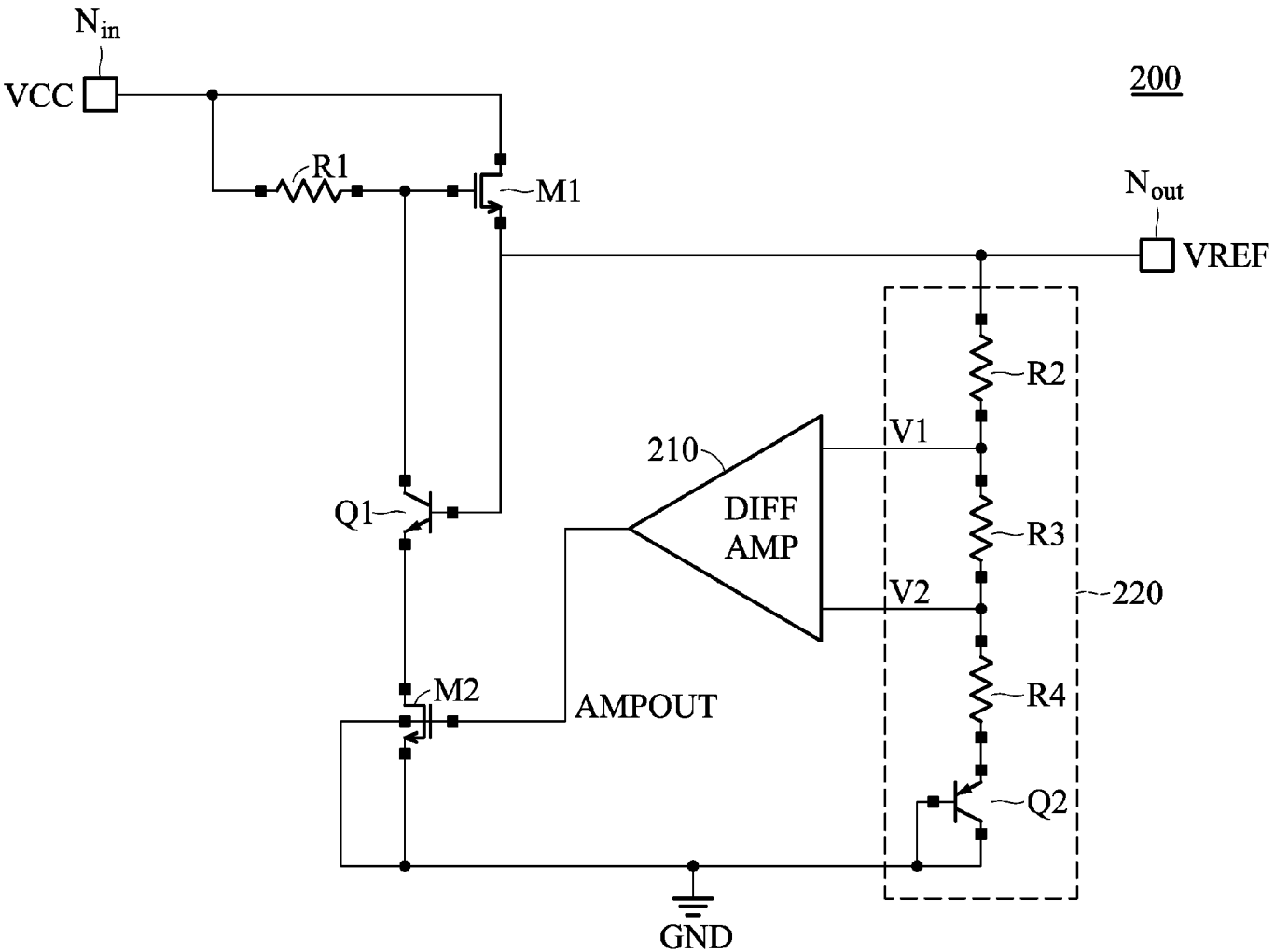
FIG. 2 shows a block diagram of a bandgap reference circuit according to an embodiment of the invention.

FIG. 2 shows a block diagram of a bandgap reference circuit 200 according to an embodiment of the invention. The bandgap reference circuit 200 may receive a supply voltage VCC from an input node $N_{in}$ and provide a reference voltage VREF at an output node $N_{out}$. The bandgap reference circuit 200 comprises the transistors M1, M2 and Q1, a resistor R1, a differential amplifier 210 and a voltage dividing unit 220. The voltage dividing unit 220 comprises three resistors R2, R3 and R4 and a transistor Q2. In this embodiment, the transistors M1 and M2 are NMOS transistors. In addition, the transistor Q1 is an NPN type BJT and the transistor Q2 is a PNP type BJT. In the bandgap reference circuit 200, the transistor M1 is coupled between the input node $N_{in}$ and the output node $N_{out}$. The resistor R1 is coupled between the input node $N_{in}$ and a gate of the transistor M1. The BJT Q1 is coupled between the gate of the transistor M1 and the transistor M2 and has a base coupled to the output node $N_{out}$. The transistor M2 is coupled between the BJT Q1 and a ground terminal GND and has a gate coupled to an output of the differential amplifier 210. In the voltage dividing unit 220, the resistor R2 is coupled between the output node $N_{out}$, and the resistor R3, and the resistor R4 is coupled between the resistor R3 and the BJT Q2 with a base coupled to the ground terminal GND.

Referring to FIG. 2, the reference voltage VREF is generated when a current flows through the voltage dividing unit 220, and two voltages V1 and V2 are also generated. A voltage across the resistor R3 (i.e. a difference between the voltages V1 and V2) may be amplified by the differential amplifier 210, and then an output signal AMPOUT of the differential amplifier 210 may control the transistor M2 to change a current flowing through the transistor M2. Due to the current flowing through the transistor M2, a voltage across the resistor R1 is changed. The changed voltage across the resistor R1 may adjust a gate to source voltage of the transistor M1, and then a current flowing through the transistor M1 is changed and the reference voltage VREF is eventually regulated to its desired value. It is to be noted that the transistor M1 has a breakdown voltage higher than the transistor M2 and the transistors of the differential amplifier 210. Moreover, the BJT Q1 provides protection to the transistor M2 by stabilizing a drain to source voltage of the transistor M2 even though the supply voltage VCC changes from a low voltage level to a high voltage level.

Figure 3:
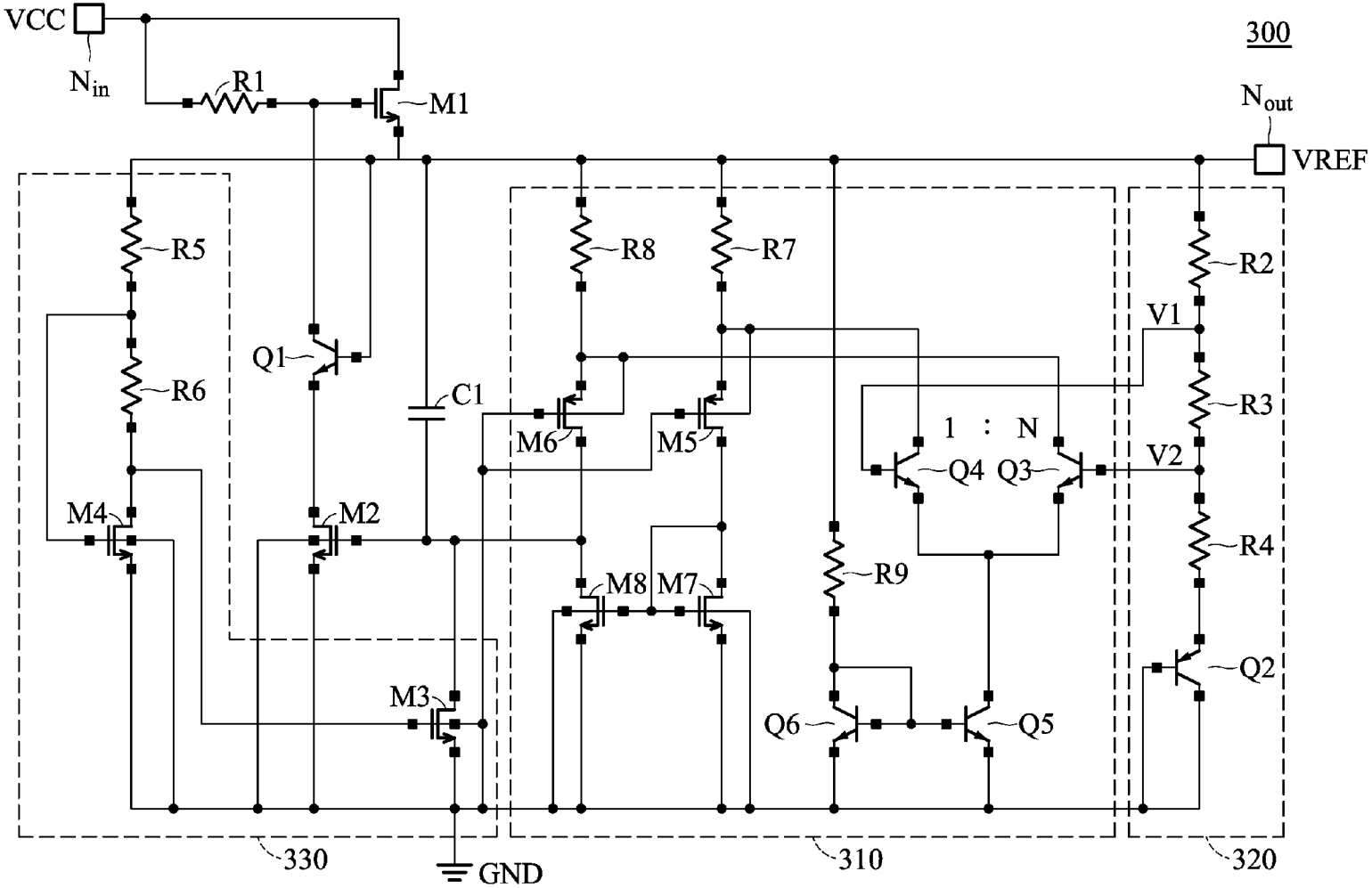
FIG. 3 shows a block diagram of a bandgap reference circuit according to another embodiment of the invention.

FIG. 3 shows a block diagram of a bandgap reference circuit 300 according to another embodiment of the invention. The bandgap reference circuit 300 may receive a supply voltage VCC from an input node $N_{in}$ and provide a reference voltage VREF at an output node $N_{out}$. The bandgap reference circuit 300 comprises the transistors M1, M2 and Q1, a resistor R1, a differential amplifier 310, a voltage dividing unit 320 and a start-up circuit 330. The differential amplifier 310 comprises the transistors M5 to M8 and Q3-Q6 and the resistors R7-R9, wherein the transistors M5 and M6 are PMOS transistors while the transistors M7 and M8 are NMOS transistors, and the transistors Q3-Q6 are NPN type bipolar junction transistors. As described above, the voltage dividing unit 320 comprises the resistors R2, R3 and R4 and a transistor Q2. The start-up circuit 330 comprises the resistors R5 and R6 and the transistors M3 and M4, wherein the transistors M3 and M4 are NMOS transistors. It is to be noted that the transistor M1 has a breakdown voltage higher than the transistor M2 and the transistors of the differential amplifier 310 and start-up circuit 330. Furthermore, a capacitor C1 is coupled between the gate of the transistor M2 and the output node $N_{out}$. The capacitor C1 is used for compensation so as to make sure the bandgap reference circuit 300 is stable.

In the start-up circuit 330, the resistor R6 is coupled between the resistor R5 and the transistor M4. The transistor M4 has a gate coupled between the resistor R5 and the resistor R6. The transistor M3 is coupled between the gate of the transistor M2 and the ground terminal GND and has a gate coupled between the resistor R6 and the transistor M4. In the differential amplifier 310, the resistors R7, R8 and R9 are coupled to the output node $N_{out}$, respectively. The transistor M6 is coupled between the resistor R8 and the transistor M8 and has a gate coupled to the ground terminal GND, while the transistor M5 is coupled between the resistor R7 and the transistor M7 and has a gate coupled to the ground terminal GND. Furthermore, the BJT Q6 is coupled between the resistor R9 and the ground terminal GND. The BJT Q5 is coupled between the ground terminal GND and a node between the pair of BJTs Q3 and Q4. The BJT Q3 is coupled between the node and the resistor R8 and has a base coupled between the resistors R3 and R4 for receiving a voltage V2. The BJT Q4 is coupled between the node and the resistor R7 and has a base coupled between the resistors R2 and R3 for receiving a voltage V1.

Referring to FIG. 3, initially, all signals of the bandgap reference circuit 300 are at low voltage level when the supply voltage VCC starts to ramp up from 0V. Next, a gate of the transistor M1 may follow the supply voltage VCC, thus a gate to source voltage of the transistor M1 is increased. A current flowing through the transistor M1 may start to increase when the supply voltage VCC is increased. The current through the transistor M1 may be supplied to all branches coupled to the transistor M1 in the bandgap reference circuit 300. Next, when the current flows through the voltage dividing unit 320, the reference voltage VREF may start to rise and the voltages V1 and V2 are also generated. Thus, a voltage across the resistor R3 (i.e. a difference between the voltages V1 and V2) may increase, and be proportional to a rise value of the reference voltage VREF.

Next, the voltage across the resistor R3 may change a difference of the current between the differential pair BJTs Q4 and Q3. In the differential amplifier 310, the BJT Q3 is 'N' times larger than the BJT Q4 to form a base to emitter voltage differential $\Delta V_{BE}$, which is a difference between the base to emitter voltages of the BJTs Q4 and Q3, wherein a current flowing through the BJT Q3 is larger than that of the BJT Q4. If the voltage across the resistor R3 is lower than the base to emitter voltage differential $\Delta V_{BE}$, the base to emitter voltage differential $\Delta V_{BE}$ may be given by the following formula (1):

$$\Delta V_{BE} = V_t \times \ln N \quad (1),$$

where $V_t$ is a thermal voltage. Because the current flowing through the BJT Q3 is larger than that of the BJT Q4 and the resistors R7 and R8 have the same resistances, a voltage across the resistor R8 is larger than a voltage across the resistor R7. Therefore, a current flowing through the transistor M6 is less than a current flowing through the transistor M5, and then the transistor M8 may pull down the gate of the transistor M2 so as to turn off the transistor M2. If there is no current flowing through the transistor M2, the BJT Q1 and the resistor R1, the gate of the transistor M1 may keep on increasing with the supply voltage VCC. Then, the reference voltage VREF may also increase until the voltage across the resistor R3 is slightly higher than the base to emitter voltage differential $\Delta V_{BE}$.

When the voltage across the resistor R3 is slightly higher than the base to emitter voltage differential $\Delta V_{BE}$, the current flowing through the BJT Q4 may become larger than that of the BJT Q3. Next, the voltage across the resistor R7 may become larger than that of the resistor R8, thus the current flowing through the transistor M6 would be larger than that of the transistor M5 and then the transistor M6 may pull up the gate of the transistor M2. Next, an increase in the gate to source voltage of the transistor M2 may draw more current and the voltage across the resistor R1 would increase. An increase of the voltage across the resistor R1 means a stable gate to source voltage of the transistor M1 that may make the current flowing through the transistor M1 to stabilize. If the current flowing through the transistor M1 is no longer increasing, the reference voltage VREF may be given by the following formula (2):

$$VREF = V_{BEQ2} + \left(\frac{R2 + R4}{R3}\right) \times V_t \times \ln N, \quad (2)$$

where $V_{BEQ2}$ is a base to emitter voltage of the BJT Q2. The base to emitter voltage $V_{BEQ2}$ has a negative temperature coefficient while the multiple of the thermal voltage $V_t$ has a positive temperature coefficient. Thus, the sum of the parameters shown in formula (2) may provide the bandgap reference circuit 300 without temperature dependence and power supply dependence.

In a power-up state, if the reference voltage VREF is lower than a base to emitter voltage of a typical 'ON' BJT, a bias current of the BJT Q5 is very low due to its low collector to emitter voltage. The bias current of the BJT Q5 is the same as the current flowing through the BJT Q6 and the resistor R9. Furthermore, a collector current of the BJT Q5 is smaller than that of the BJT Q6 due to the BJT Q5 being operated in a saturation region. Similarly, the collector to emitter voltages of the BJTs Q3 and Q4 are also low, so the BJTs Q3 and Q4 are operated in a saturation region. At this time, there is no differential current between the BJTs Q3 and Q4 and hence the gate of the transistor M2 may be settled to any value since the differential amplifier 310 is not working. Because noise or device mismatch may exist in the bandgap reference circuit 300, the gate of the transistor M2 may be high enough to draw current into the transistor M2. Hence, the voltage across the resistor R1 may increase and then the current flowing through the transistor M1 may decrease. Thus, the reference voltage VREF may stop increasing and stay to a value lower than the desired value.

When the reference voltage VREF is lower than a base to emitter voltage of a typical 'ON' BJT, the start-up circuit 330 may pull down the gate of the transistor M2 to make sure the current is still flowing through the transistor M1. By turning off the transistor M2, the gate of the transistor M1 may equal to the supply voltage VCC and thereby provide current to all branches of the bandgap reference circuit 300. When the reference voltage VREF exceeds a base to emitter voltage of a typical 'ON' BJT, the differential amplifier 310 may start to work and the transistor M3 may be turned off. Since the differential amplifier 310 is working, the reference voltage VREF may be stabilized to the value given in formula (2).

As described above, the bandgap reference circuit is suitable for a BCD process. Furthermore, the bandgap reference circuit may provide high voltage and low quiescent current. Moreover, the bandgap reference circuit may achieve low reference voltage variation and have a low quiescent current within a wide power supply voltage range.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A bandgap reference circuit, comprising:

an input node for receiving a supply voltage;

an output node for providing a reference voltage;

a first transistor coupled between the input node and the output node, having a first control terminal;

a first resistor coupled between the input node and the first control terminal;

a second transistor coupled to the first control terminal, having a second control terminal coupled to the output node;

a third transistor coupled between the second transistor and a ground terminal, having a third control terminal;

a voltage dividing unit, providing a first voltage and a second voltage according to the reference voltage; and a differential amplifier, providing a signal to the third control terminal according to a difference between the first voltage and the second voltage.

2. The bandgap reference circuit as claimed in claim 1, wherein the first transistor and the third transistor are NMOS transistors, and the first transistor has a breakdown voltage higher than the third transistor.

3. The bandgap reference circuit as claimed in claim 1, wherein the second transistor is an NPN type bipolar junction transistor.

4. The bandgap reference circuit as claimed in claim 1, wherein the voltage dividing unit comprises:

a second resistor coupled to the output node;

a third resistor coupled to the second resistor;

a fourth resistor coupled to the third resistor; and a PNP type bipolar junction transistor coupled between the fourth resistor and the ground terminal, having a base coupled to the ground terminal, wherein the difference between the first voltage and the second voltage is a voltage across the third resistor.

5. The bandgap reference circuit as claimed in claim 1, further comprising a capacitor coupled between the output node and the third control terminal.

6. The bandgap reference circuit as claimed in claim 1, further comprising:

a start-up circuit coupled between the output node and the third control terminal.

7. The bandgap reference circuit as claimed in claim 6, wherein the start-up circuit comprises:

a fourth transistor coupled between the third control terminal and the ground terminal, having a fourth control terminal;

a fifth resistor coupled to the output node;

a sixth resistor coupled between the fifth resistor and the fourth control terminal; and a fifth transistor coupled between the fourth control terminal and the ground terminal, having a fifth control terminal coupled between the fifth resistor and the sixth resistor.

8. The bandgap reference circuit as claimed in claim 1, wherein the differential amplifier comprises:

a seventh resistor, an eighth resistor and a ninth resistor respectively coupled to the output node;

a first PMOS transistor coupled to the seventh resistor, having a gate coupled to the ground terminal;

a second PMOS transistor coupled between the eighth resistor and the third control terminal, having a gate coupled to the ground terminal;

a first NMOS transistor coupled between the first PMOS transistor and the ground terminal, having a gate coupled to the first PMOS transistor;

a second NMOS transistor coupled between the third control terminal and the ground terminal, having a gate coupled to the gate of the first NMOS transistor;

a first bipolar junction transistor coupled between the eighth resistor and a node, having a base for receiving the second voltage;

a second bipolar junction transistor coupled between the seventh resistor and the node, having a base for receiving the first voltage;

a third bipolar junction transistor coupled between the node and the ground terminal, having a base coupled to the ninth resistor; and a fourth bipolar junction transistor coupled between the ninth resistor and the ground terminal, having a base coupled to the ninth resistor.

9. The bandgap reference circuit as claimed in claim 8, wherein the first, second, third and fourth bipolar junction transistors are NPN bipolar junction transistors.

10. The bandgap reference circuit as claimed in claim 8, wherein the first bipolar junction transistor is larger than the second bipolar junction transistor such that a difference between the base to emitter voltages of the first bipolar junction transistor and the second bipolar junction transistor is formed.

11. A bandgap reference circuit, comprising:

an input node for receiving a supply voltage;

an output node for providing a reference voltage;

a first transistor coupled between the input node and the output node, having a gate;

a first resistor coupled between the input node and the gate of the first transistor;

a first NPN type bipolar junction transistor coupled to the gate, having a base coupled to the output node;

a second transistor coupled between the first NPN type bipolar junction transistor and a ground terminal, having a gate;

a voltage dividing unit, providing a first voltage and a second voltage according to the reference voltage; and a differential amplifier, providing a signal to the gate of the second transistor according to a difference between the first voltage and the second voltage, wherein the first transistor and the second transistor are NMOS transistors, and the first transistor has a breakdown voltage higher than the third transistor.

12. The bandgap reference circuit as claimed in claim 11, wherein the voltage dividing unit comprises:

a second resistor coupled to the output node;

a third resistor coupled to the second resistor;

a fourth resistor coupled to the third resistor; and a PNP type bipolar junction transistor coupled between the fourth resistor and the ground terminal, having a base coupled to the ground terminal, wherein the difference between the first voltage and the second voltage is a voltage across the third resistor.

13. The bandgap reference circuit as claimed in claim 11, further comprising a capacitor coupled between the output node and the gate of the second transistor.

14. The bandgap reference circuit as claimed in claim 11, further comprising:

a start-up circuit coupled between the output node and the gate of the second transistor.

15. The bandgap reference circuit as claimed in claim 14, wherein the start-up circuit comprises:

a third transistor coupled between the gate of the second transistor and the ground terminal, having a gate;

a fifth resistor coupled to the output node;

a sixth resistor coupled between the fifth resistor and the gate of the third transistor; and a fourth transistor coupled between the gate of the third transistor and the ground terminal, having a gate coupled between the fifth resistor and the sixth resistor.

16. The bandgap reference circuit as claimed in claim 15, wherein the breakdown voltage of the first transistor is higher than that of the third transistor and the fourth transistor.

17. The bandgap reference circuit as claimed in claim 11, wherein the differential amplifier comprises:

a seventh resistor, an eighth resistor and a ninth resistor respectively coupled to the output node;

a fifth transistor coupled to the seventh resistor, having a gate coupled to the ground terminal;

a sixth transistor coupled between the eighth resistor and the gate of the second transistor, having a gate coupled to the ground terminal;

seventh transistor coupled between the fifth transistor and the ground terminal, having a gate coupled to the fifth transistor;

an eighth transistor coupled between the gate of the second transistor and the ground terminal, having a gate coupled to the gate of the seventh transistor;

a second NPN type bipolar junction transistor coupled between the eighth resistor and a node, having a base for receiving the second voltage;

a third NPN type bipolar junction transistor coupled between the seventh resistor and the node, having a base for receiving the first voltage;

a fourth NPN type bipolar junction transistor coupled between the node and the ground terminal, having a base coupled to the ninth resistor; and a fifth NPN type bipolar junction transistor coupled between the ninth resistor and the ground terminal, having a base coupled to the ninth resistor.

18. The bandgap reference circuit as claimed in claim 17, wherein the fifth transistor and the sixth transistor are PMOS transistors, and the seventh transistor and the eighth transistor are NMOS transistors.

19. The bandgap reference circuit as claimed in claim 17, wherein the second NPN type bipolar junction transistor is larger than the third NPN type bipolar junction transistor such that a difference between the base to emitter voltages of the second and third NPN type bipolar junction transistors is formed.

20. The bandgap reference circuit as claimed in claim 17, wherein the breakdown voltage of the first transistor is higher than that of the fifth, sixth, seventh and eighth transistors.

* * * * *